US007336339B2

(12) United States Patent
Ho

(10) Patent No.: US 7,336,339 B2
(45) Date of Patent: Feb. 26, 2008

(54) LED DISPLAY APPARATUS

(76) Inventor: Wai Ho, Rm D, 39/F., Tower III, Grandview Garden, Hammer Hill Road, Diamond Hill, Kowloon (HK)

( * ) Notice: Subject to any disclaimer, the term of this patent is extended or adjusted under 35 U.S.C. 154(b) by 91 days.

(21) Appl. No.: 11/293,566

(22) Filed: Dec. 2, 2005

(65) Prior Publication Data

US 2006/0119542 A1 Jun. 8, 2006

(30) Foreign Application Priority Data

Dec. 6, 2004 (CN) ..... 2004 2 0102021 U

(51) Int. Cl.
*F21V 7/04* (2006.01)
*H01J 1/62* (2006.01)

(52) U.S. Cl. ..... 352/555; 362/241; 313/512; 313/513

(58) Field of Classification Search ..... 313/513, 313/512, 510, 500, 498; 362/555, 558, 559, 362/560, 227, 241, 244, 247, 296, 341
See application file for complete search history.

(56) References Cited

U.S. PATENT DOCUMENTS 3,911,430 A * 10/1975 Jankowski et al. ..... 313/500
5,836,676 A * 11/1998 Ando et al. ..... 362/244
6,208,078 B1 * 3/2001 Fujii et al. ..... 313/510

* cited by examiner

*Primary Examiner*—Sandra O'Shea
*Assistant Examiner*—Bao Q. Truong
(74) *Attorney, Agent, or Firm*—J.C. Patents

(57) ABSTRACT

A LED display apparatus is disclosed, in which a LED array (7) arranged according to the shape of patterns or characters to be displayed is fixed on a PCB (3), the LED array is connected to a LED driving controller (6), optical conductive ink (5) is distributed around the LEDs on the PCB (3), above the LEDs and the optical conductive ink (5) is disposed an optical conductive bracket (2) having a cross section corresponding to the shape of the patterns or characters to be displayed, and a diffuser (1) is placed on the top of the optical conductive bracket (2).

9 Claims, 4 Drawing Sheets

LED DISPLAY APPARATUS

TECHNICAL FIELD

The present invention relates to a LED display apparatus.

BACKGROUND ART

The technical measures used in the existing LED reflective display apparatuses, especially digital watches basically follow the designs of 70's. The method of the LED digital display is basically the same as that of the LCD digital display. When displaying digits, digital characters can be simply divided into 7 display segments, and the luminescence of different segments can be combined to display different numerical values. Since in the conventional LED digit displaying method, the digits are made up by special luminescent rectangular LEDs as shown in FIG. 5*a*, when the LEDs luminesce, the digital display segments are thin and small, and a simple 4-digit numerical value LED display module must be accomplished by a specialized manufacturer having special manufacturing techniques, and can not be produced by a general watch manufacturer. The module must be purchased from the specialized manufacturer, and its price being expensive, its displayed character size and shape is only of one kind and has no variation. Such features as single color and high power consumption influence the commercial value of the product.

SUMMARY OF THE INVENTION

The objects of the present invention are to:

(1) provide a LED display apparatus using a single LED to display a plurality of kinds of digital characters or patterns of various shapes and sizes, without using a specialized LED digital display module; and (2) provide a LED display apparatus capable of forming digitally displayed time characters or patterns which are full and uniform, by using a few LEDs to project on a diffuser.

The main technical scheme of the present invention is as follows.

A LED array arranged according to the shape of patterns or characters to be displayed is fixed on a PCB. The LED array is connected to a LED driving controller. Light reflecting ink is distributed around the LEDs on the PCB. Above the LEDs and the light reflecting ink is disposed an optical conductive bracket having a cross section corresponding to the shape of the patterns or characters to be displayed. A diffuser is placed on the top of the bracket.

Since the LED digital characters or patterns are composed of different display segments, in order to save electricity, only one LED is responsible for luminescing and displaying a segment. But if a segment or a stroke is displayed by using the rays emitted by only one LED, a highlighted facula will be generated at the middle of the stroke needed to be displayed by luminescence, which kind of facula can influence the display visual effect severely, while the intensity of the rays emitted from the edges of each display segment are not sufficient, losing living and complete character display effect. If a plurality of LEDs are used, the cost will increase. In order to solve this problem, in the technical solution of the present utility model, in a LED digital display timing apparatus, each LED digital character in luminescent display comprises an optical conductive bracket capable of forming a digital character shape, a diffuser, a LED array arranged in a character shape, light reflecting ink distributed around the LED, and a circuit board as a substrate of the LED characters. The LEDs in each LED array are capsulation by surface mount devices (SMDs) or dices. When a LED emits rays, a part of the rays are reflected by the light reflecting ink in a character reflective area to generate reflected rays, and it is formed with an oblique plane of the optical conductive bracket, a cavity capable of generating an effect of reflecting and enhancing rays repeatedly. The rays in the cavity can finally be reflected or scattered uniformly onto the diffuser located on the front end of the optical conductive bracket, and the diffuser can produce a secondary refraction and reflection on the rays, enhancing again the uniform luminescence effect of the LED characters. Based on this kind of structure, a LED display device for displaying digits can be implemented by using a few LEDs finally. Of course the structure can also be applied to a pattern display device.

BRIEF DESCRIPTION TO THE DRAWINGS

FIG. 1*a* is an arrangement diagram of distribution of a LED dice array on a circuit board;

FIG. 1*b* is diagram showing positions of the LED dices on a LED display segment;

Figure 4A:
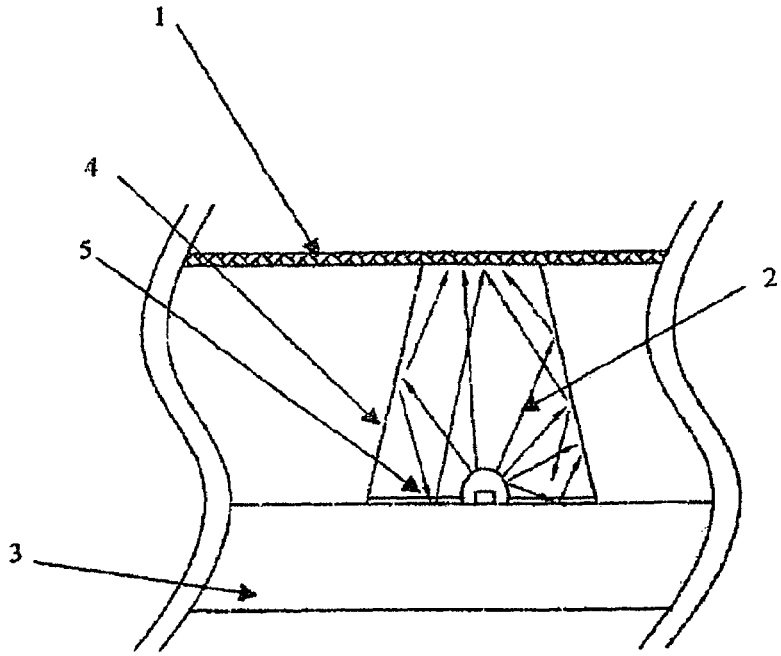
Figure 4B:
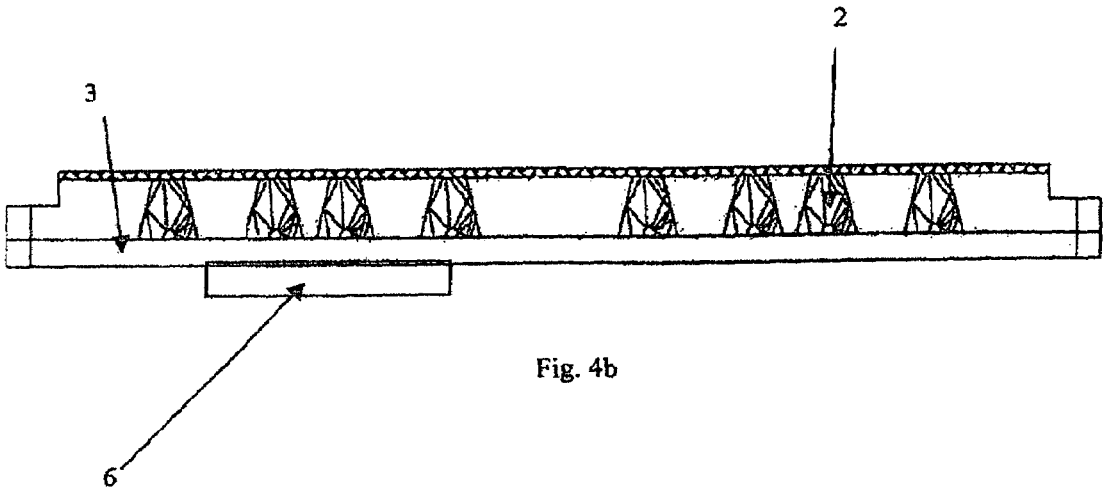
Figure 5A:
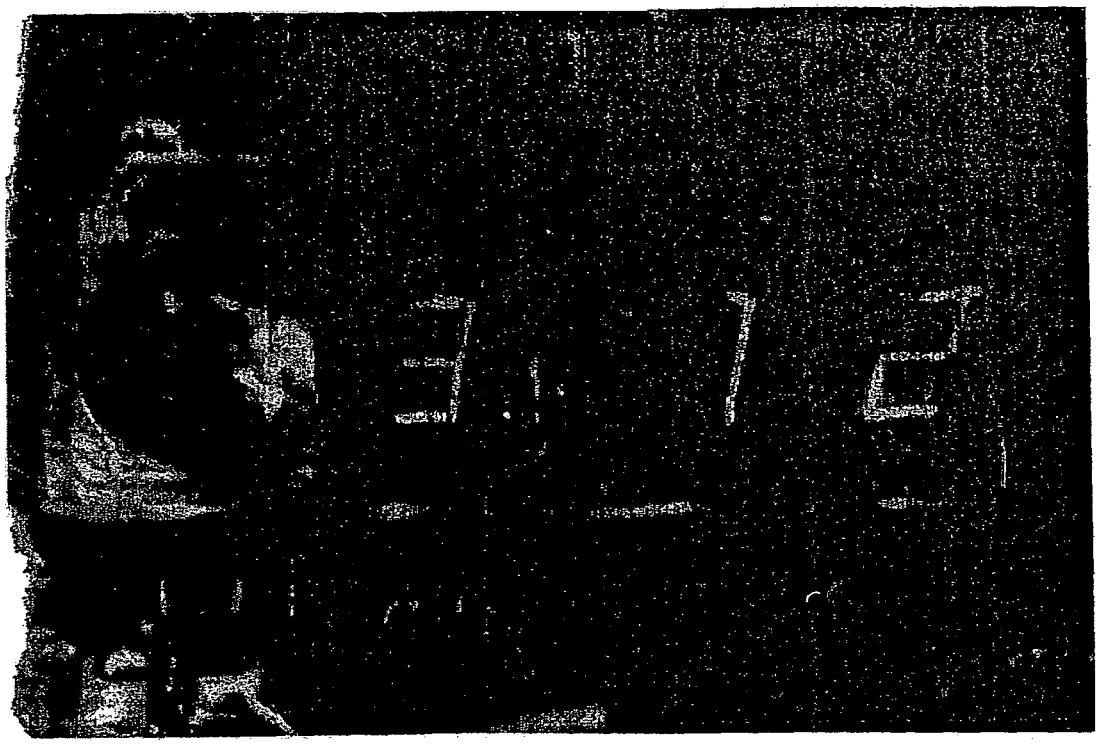
Figure 5B:
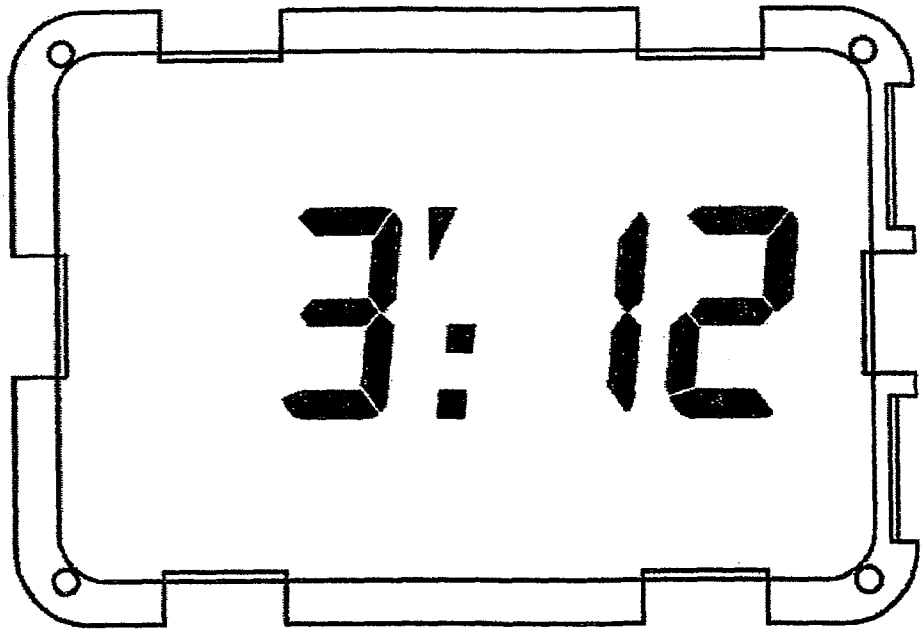

FIG. 4*a* is a schematic diagram of the structure of the present utility model;

FIG. 4*b* is a schematic diagram of a structure according to an embodiment of a digital timing apparatus;

FIG. 5*a* is a diagram of the luminescence of a LED before improvement showing the time of 12 past 3 o'clock; and FIG. 5*b* is a diagram of the luminescence of a LED after improvement showing the time of 12 past 3 o'clock.

BEST MODES FOR CARRYING OUT THE INVENTION

As shown in FIG. 4, in the LED display apparatus, a LED array 7 arranged according to the shape of the patterns or characters to be displayed is fixed on a PCB (printing circuit board) 3. The LED array is connected to a LED drive controller 6. Light reflecting ink 5 is distributed around a LED on the PCB 3. An optical conductive bracket 2, the cross section of which corresponds to the shape of a pattern or character to be displayed, is arranged on a LED and light reflecting ink 5. A diffuser 1 is placed on the top of the optical conductive bracket 2.

The optical conductive bracket 2 has a cavity, the upper part of which is smaller and the lower part of which is bigger. The internal side wall of the cavity and the PCB 3 form an angle less than 90°. Inside the cavity is filled with epoxide resin.

There is a transparent part at the top of the optical conductive bracket 2, its shape and size is consistent with the display segment of the pattern or character to be displayed by luminescence, and its outline shape of the bottom conforms to the shape of the optical conductive ink 5 on the PCB 3.

Therein, LEDs in each LED array can be capsulation by SMDs or dices. Each LED is directly placed on the position of each corresponding display segment of the LED display pattern or character on the PCB.

Figure 1A:
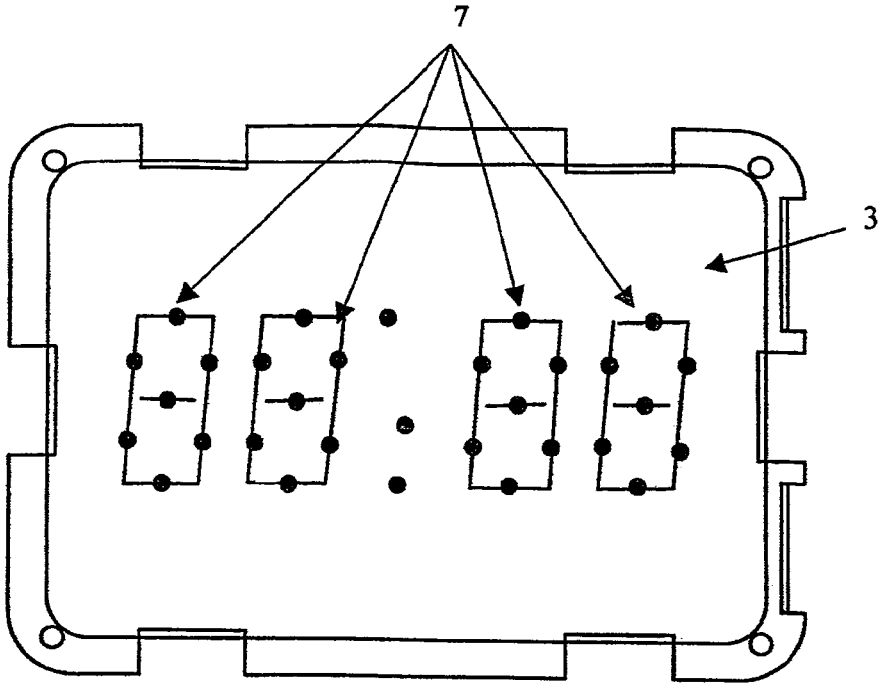
Figure 1B:
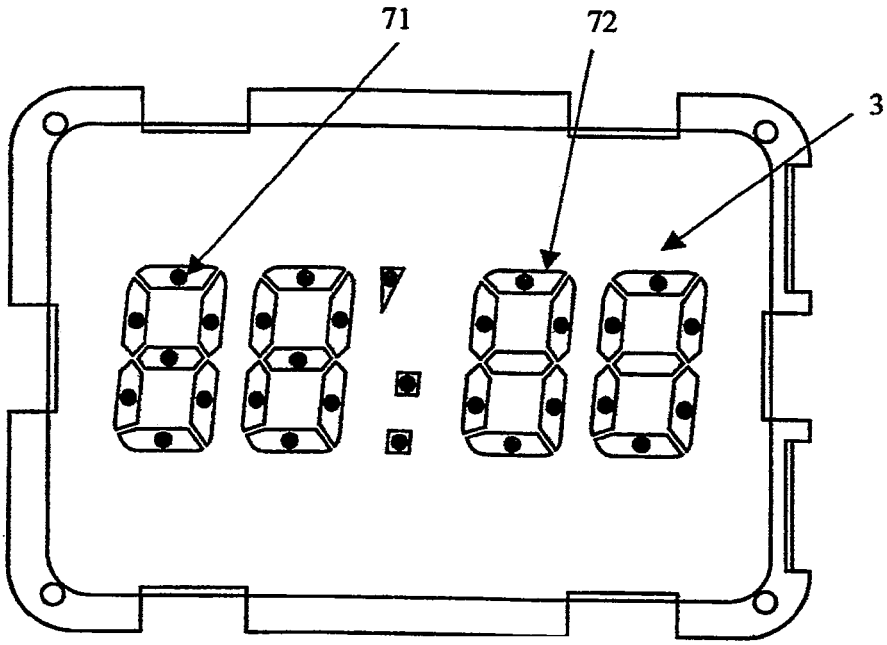
Figure 2:
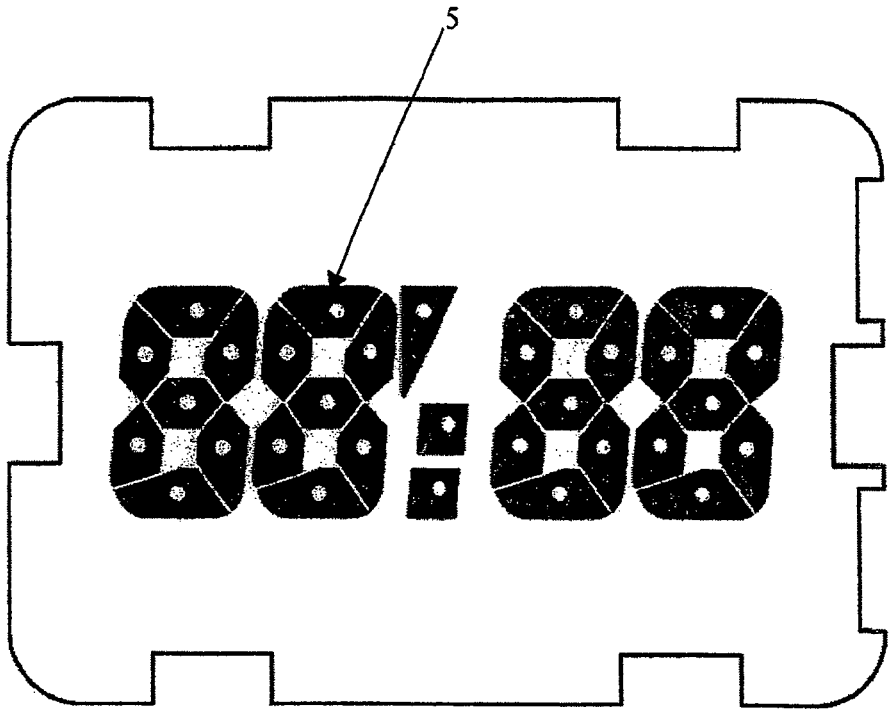
FIG. 2 is a schematic diagram showing the light reflecting ink distributed around the LED dices.
Figure 3:
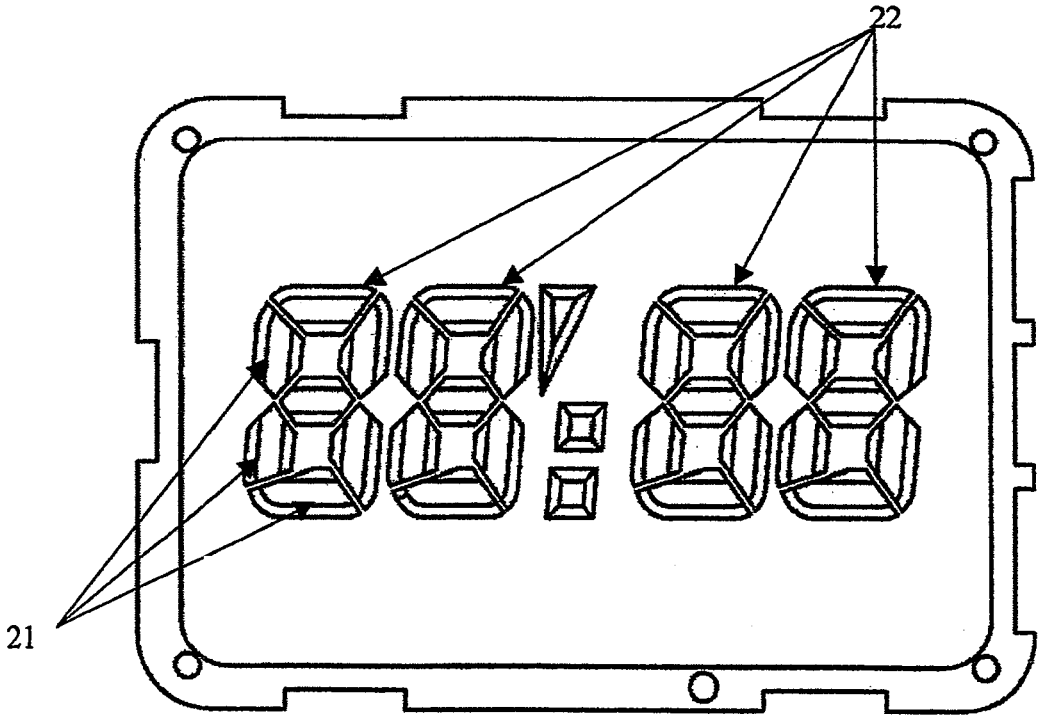
FIG. 3 is a perspective elevation view of the front side of the optical conductive bracket.

The following is an embodiment of the LED display apparatus applied in a LED luminescence watch. In FIG. 1*a* is shown a LED array 7 arranged according to the character design of the LED luminescence watch displaying 4-digit value. In FIG. 1*b*, a LED dice 71 is directly placed on and welded at a position on the PCB 3. Each LED numeral is composed of 7 display segments. The luminescence of each display segment is done by a LED. One numeral needs 7 LEDs in total. There are altogether 31 LED dices in which 3 of them are for symbol display. The position of each LED is located at the midpoint of a display segment 72 the luminescence of which the LED is responsible for. Around the LED dices on the circuit board is distributed a layer of light reflecting ink 5, i.e. the black shaded portion in FIG. 2. The shape and size of the light reflecting ink 5 matches the size 22 of an internal wall at the bottom of the bracket as shown in FIGS. 4*a* and 4*b*. The shape and size of a LED display character 21 in FIG. 3 are identical to those of a numeral character needed to be displayed. By a reflection effect generated by the optical conductive ink, the rays emitted by the LEDs can be reflected to an internal side wall 4 of the bracket as shown in FIGS. 4*a* and 4*b*. Since an angle formed between the internal side wall 4 of the bracket and the circuit board 3 can well emit again the rays from the LEDs and the rays reflected by the light reflecting ink 5 to the inside of the cavity formed by the optical conductive bracket and the circuit board 3, the rays inside the cavity can be reflected for many times, respectively, as shown in FIGS. 4*a* and 4*b*. Finally, the rays of the cavity are enabled to pass through a transparent part on the top the optical conductive bracket the shape of which is the same as that of the numeral character of the needed LED luminescence display segment, allowing the rays to project on a diffuser 1 uniformly and then to be diffused by the reflection and scattering effect of the diffuser 1 so that the rays generated by a single LED can be displayed uniformly according to the shape of the numeral character on the top of the optical conductive bracket. It seems that each display segment of the numeral looks like a hilly luminescent entity to display the character as shown in FIG. 5*b*. FIG. 5*a* is a diagram showing a display effect of a conventional LED watch. In FIG. 4, there is a LED array drive controller 6 including a microprocessor which is located at the bottom of the circuit board 3, while the LED display array is located at the top layer of the circuit board 3.

FIG. 3 is a perspective elevation view of the front side of the optical conductive bracket. Reference numeral 21 indicates the transparent part on the top, the dimension, shape and size of which is identical to that of the numeral character to be displayed, Reference numeral 22 indicates the internal wall frame at the bottom of the optical conductive bracket. The size of 22 is larger than that of 21, forming a cavity with a smaller upper part and a bigger lower part. As can be seen in the diagram, the numeral is composed of the display segments, each of which is a cavity with a smaller upper part and a bigger lower part, in a same shape as that of the character to be displayed. But the shape of the cavity can be any one, and thus the rays emitted by a LED can be projected out simply according to the shape of the cavity so as to form various types of LED numeral display.

Since the LED dices are directly welded onto the circuit board, the dices and aluminum wires on the LEDs are permanently exposed in the air, thus can be corroded and are easily to be destroyed. After fabrication, the optical conductive bracket is installed on the circuit board and then epoxide resin is filled into the cavity of the optical conductive bracket as shown in FIGS. 4*a* and 4*b* to protect the LEDs, which simultaneously enhances the optical conductive performance of the optical conductive bracket.

What is claimed is:

1. A LED display apparatus, characterized in that, a LED array arranged according to the shape of patterns or characters to be displayed is fixed on a PCB, the LED array is connected to a LED driving controller, light reflecting ink is distributed around LEDs of the LED array on the PCB, above the LEDs and the light reflecting ink is disposed an optical conductive bracket having a cross section corresponding to the shape of the patterns or characters to be displayed, and a diffuser is placed on the top of the optical conductive bracket, wherein the optical conductive bracket has a cavity, the upper part of which is smaller and the lower part of which is bigger, and an internal side wall of the cavity of the optical conductive bracket and the PCB form an angle less than 90°.

2. The LED display apparatus according to claim 1, characterized in that there is a transparent part at the top of the optical conductive bracket, and its shape and size are consistent with a display segment of the patterns or characters to be displayed by luminescence.

3. The LED display apparatus according to claim 1, characterized in that an outline shape of a bottom of the optical conductive bracket conforms to a shape of the light reflecting ink on the PCB.

4. The LED display apparatus according to claim 1, characterized in that inside the cavity of the optical conductive bracket is filled with epoxide resin.

5. The LED display apparatus according to claim 2, characterized in that inside the cavity of the optical conductive bracket is filled with epoxide resin.

6. The LED display apparatus according to claim 3, characterized in that inside the cavity of the optical conductive bracket is filled with epoxide resin.

7. The LED display apparatus according to claim 1, characterized in that the LEDs in the LED array are capsulated by SMDs or dices, wherein each LED is directly placed at the position of each corresponding display segment of the patterns or characters on the PCB.

8. The LED display apparatus according to claim 1, characterized in that each of the LEDs is covered by one corresponding optical conductive bracket.

9. The LED display apparatus according to claim 1, characterized in that the internal sidewall of the cavity of the optical conductive bracket is made of a reflecting material.

* * * * *